US007137451B2

(12) United States Patent
Smith

(10) Patent No.: US 7,137,451 B2
(45) Date of Patent: Nov. 21, 2006

(54) CONTROLLING AND/OR TESTING A HYDROCARBON PRODUCTION SYSTEM

(75) Inventor: David Martin Smith, Bristol (GB)

(73) Assignee: Vetco Gray Controls Limited, Bristol (GB)

( * ) Notice: Subject to any disclaimer, the term of this patent is extended or adjusted under 35 U.S.C. 154(b) by 0 days.

(21) Appl. No.: 10/680,942

(22) Filed: Oct. 8, 2003

(65) Prior Publication Data

US 2004/0069492 A1 Apr. 15, 2004

(30) Foreign Application Priority Data

Oct. 10, 2002 (GB) ..... 0223641.2

(51) Int. Cl.
*E21B 29/12* (2006.01)
*E21B 7/12* (2006.01)

(52) U.S. Cl. ..... 166/335; 166/336; 166/366

(58) Field of Classification Search ..... 166/335, 166/336, 366
See application file for complete search history.

(56) References Cited

U.S. PATENT DOCUMENTS 3,261,398 A * 7/1966 Haeber ..... 166/352
3,504,741 A * 4/1970 Talley, Jr. et al. ..... 166/356
3,517,735 A * 6/1970 Fairbanks et al. ..... 166/366
4,052,703 A * 10/1977 Collins et al. ..... 714/2
4,378,848 A * 4/1983 Milberger ..... 166/351
4,497,369 A 2/1985 Hurta et al.
4,625,805 A * 12/1986 Ladecky ..... 166/341
4,848,474 A * 7/1989 Parizot et al. ..... 166/366
4,848,475 A * 7/1989 Dean et al. ..... 166/357
5,025,865 A * 6/1991 Caldwell et al. ..... 166/366
5,192,167 A * 3/1993 da Silva et al. ..... 405/195.1
5,255,744 A * 10/1993 Silva ..... 166/347
5,295,546 A * 3/1994 Giannesini et al. ..... 166/353
6,059,039 A 5/2000 Bednar et al.
2004/0144543 A1 * 7/2004 Appleford et al. ..... 166/336

FOREIGN PATENT DOCUMENTS

GB 2059534 * 4/1981
WO WO02/072999 A1 9/2002

* cited by examiner

*Primary Examiner*—Thomas A Beach
(74) *Attorney, Agent, or Firm*—Bracewell & Giuliani LLP

(57) ABSTRACT

A system for use in controlling and/or testing an underwater hydrocarbon production system, has a number of control modules for controlling well trees. The control modules are provided, not at the trees, but at a control center for location underwater. The trees are in communication with associated ones of the control modules.

15 Claims, 1 Drawing Sheet

CONTROLLING AND/OR TESTING A HYDROCARBON PRODUCTION SYSTEM

CROSS-REFERENCE TO RELATED APPLICATION

This application claims the benefit of United Kingdom Patent Application No. 0223641.2, filed on Oct. 10, 2002, which hereby is incorporated by reference in its entirety.

TECHNICAL FIELD OF THE INVENTION

The present invention relates to controlling and/or testing a hydrocarbon production system.

BACKGROUND OF THE INVENTION

FIG. 1 shows, diagrammatically, a typical arrangement for the control of fluid extraction from each of, in the example, four wells of a hydrocarbon extraction field. Such arrangements are typical for a field of subsea wells. The field is connected to an umbilical 1 terminated by a seabed umbilical termination assembly (UTA) 2 which, typically, supplies control signals to subsea control modules (SCM's) 3 mounted on Christmas trees (XT's) fitted to the wellheads. Sometimes, the UTA 2 feeds control signals directly to an SCM 5 mounted on a manifold 6 which controls the fluid extraction output from the field. Alternatively, the manifold 6 can be controlled by an SCM 3 mounted on one of the Christmas trees or its functions shared between several SCM's on more than one tree. Typically, the umbilical 1 also feeds hydraulic fluid under pressure to operate hydraulically operated devices such as chokes and valves, plus electric power supplies to the SCM's, and sometimes electric power to operate electrically operated devices as well. The umbilical 1 also carries electrical signals from sensors fitted to the system, such as pressure and temperature sensors, to provide monitoring data to assist the operator in controlling the field. The other end of the umbilical 1 terminates on a surface vessel or a platform or sometimes on land, which carries the controlling equipment and interfaces to the operator. The extracted fluid output from each well is fed to the manifold 6 and then to the field output flowlines 7 to the surface vessel, platform or land base.

One disadvantage of this system is that the Christmas trees 4 and the manifold 6 are heavy and complicated by the attachment of a SCM to each of them, thus making them expensive to manufacture and install. A further disadvantage is that the UTA 2 is also heavy and complicated.

SUMMARY OF THE INVENTION

According to the present invention, there is provided apparatus for use in controlling and/or testing an underwater hydrocarbon production system, the apparatus comprises a plurality of control modules for controlling a plurality of well trees. The control modules are provided, not at the trees, but at a control center for location underwater. The trees are in communication with associated ones of control modules in use of the apparatus.

The apparatus may include means for coupling said control center with a remote control location, such as termination means for location underwater for supplying control signals from said remote control location to said control modules. The apparatus could include a manifold in communication with the trees in use of the apparatus for controlling hydrocarbon extraction, there being a control module for controlling the manifold, which module is provided, not at the manifold, but at said control center. The present invention also comprises a control center provided with a plurality of control modules for use in apparatus according to the invention.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
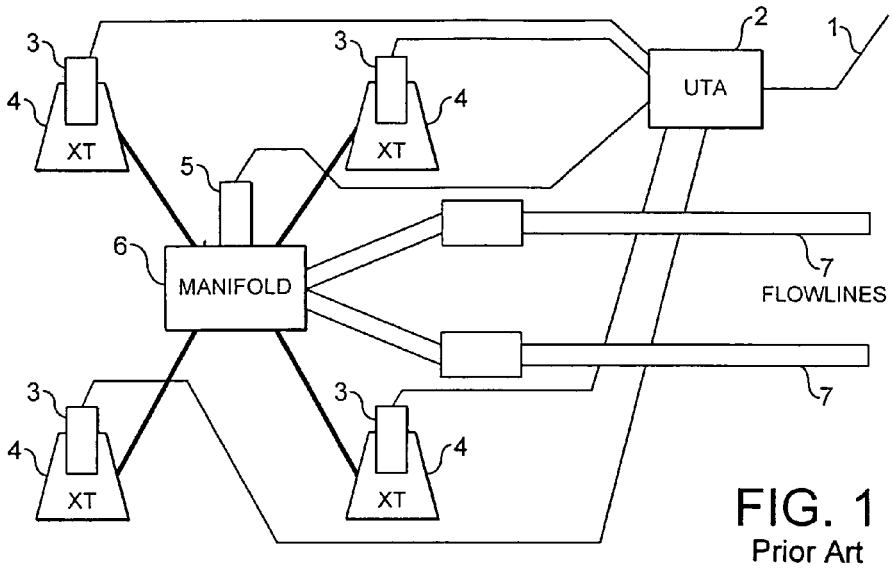
FIG. 1 Prior Art
FIG. 1 is a diagrammatic view of a known arrangement for controlling hydrocarbon fluid extraction.
Figure 2:
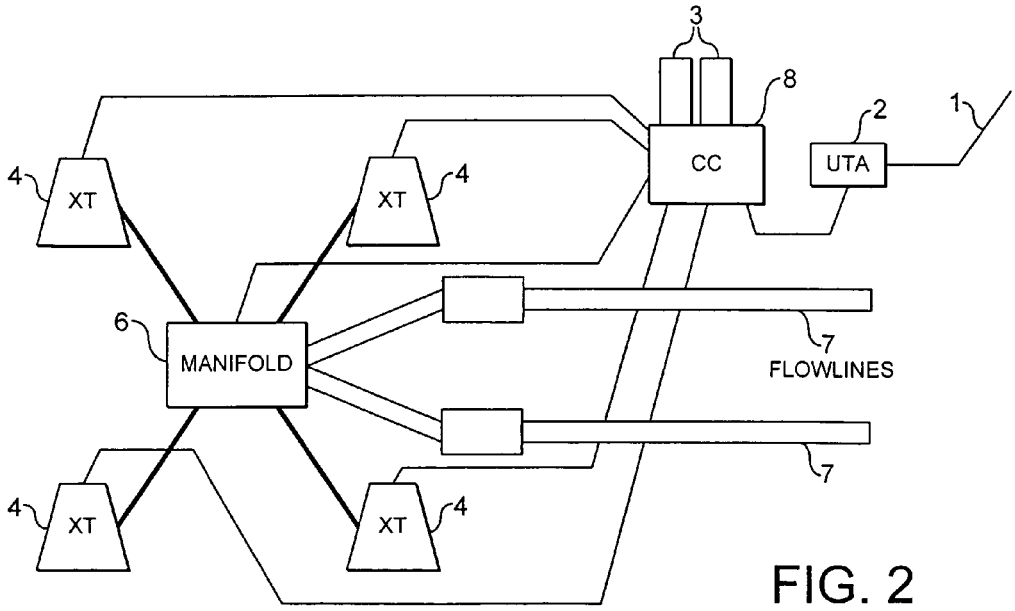
FIG. 2 is a diagrammatic view of an example of the present invention.

Referring to FIG. 2 (in which items which are the same as those in FIG. 1 have the same reference numerals as in FIG. 1), as with the conventional system an umbilical 1 terminates at a UTA 2. Instead of the UTA being connected to SCM's mounted on Christmas trees 4, it is connected to a control center (CC) 8. This CC 8 houses all of the SCM's 3 required to operate the wells and a manifold 6. Since there are no SCM's at the Christmas trees or the manifold, they are replaced in each case by a single connector interface panel (a stab plate) to facilitate connection to the CC 8. The advantages of this arrangement are as follows:—

1. Lighter trees and manifold. The removal of an SCM and its mounting base from each of the Christmas trees and the manifold makes them much lighter, and there is also a corresponding reduction in the support structure, guidance steelwork and balancing weights. Furthermore, the height of a tree is often dictated by the height of its SCM so its removal often makes the height of each tree less. These reductions in size and weight can result in a smaller and cheaper rig being adequate to install each tree.

2. Standard interface to the trees. Data sent down the umbilical 1 to control each tree 4 is typically in digital form sent serially down one pair of wires or optical fibre in the umbilical. This means that such data has to include an address to identify which SCM is to receive the data. This means that each SCM on each tree is different in that each has a different address and thus each tree is different. Furthermore, when the SCM on a tree also controls the functions of the manifold or a number of SCM's on trees share the control of the manifold, the SCM's will have differences. Removal of the SCM's from the trees thus enables all trees to be identical and each to have the same simple interface at a single stab plate. This has long been a desirable aspect for the user.

3. Simplified integration testing. It follows from 2. above that as the trees and manifold only have a stab plate interface to the CC8, their integration testing is simplified and the integration test of the control system only needs to be performed once at the manufacturing plant. Thus, there is no need for specialised equipment and personnel to test the trees during installation.

4. Reduction in engineering. Since the SCM's on some trees often perform the dual role of control of the tree and a partial or full control of the manifold, the SCM's on some trees are different to those that control a tree only. Fitting a single design of SCM to all trees makes all of the trees heavy and more complex than required. Fitting of the SCM's to a control center facilitates a common design of SCM, thus reducing engineering costs.

5. Reduction in cost. Mounting the SCM's at a control center makes it practical to offer a system where one control module operates more than one tree. Cost analysis has shown that an arrangement whereby one SCM controls two trees and half of a manifold is likely to have the maximum cost saving.

SCM's are usually fitted with hydraulic accumulators to provide a reservoir of hydraulic pressure. This is necessary when hydraulic devices are operated, both to prevent a drop in hydraulic pressure resulting from the long umbilical from the hydraulic source and to provide a back-up source of hydraulic power in the event of failure of the source pressure. Mounting of the SCM's at a control center facilitates the hydraulic accumulators being combined into fewer, but larger, accumulators with the consequential reduction in pipework, thus further reducing costs.

6. Simplifies umbilical installation and design. UTA's on conventional systems require a large assembly of stab plates to accommodate the multiplicity of interface jumpers to each tree. Thus, the design of UTA's are different for systems with different numbers of trees in the field and the bulk of the UTA attached to the umbilical makes installation of the umbilical, which may be several kilometres long, difficult. The UTA required for this example of the invention would only need a single stab plate to provide a connection point for a jumper to the control center, making installation of the umbilical easier and facilitating the possibility of a single UTA design for all projects.

7. Simplifies work-over. When a well is commissioned (work-over) it is necessary to provide direct access at a tree to its actuating devices and sensors. This is normally facilitated by the addition of a set of interfaces specifically for work-over to effectively by-pass the complex functions of the SCM. Removal of the SCM from each tree and its replacement by a simple interface stab plate enables these interfaces to be the same for both work-over and connection to the control center for production control. This further simplifies the trees and the provision of work-over facilities.

8. Reduction in risk of chemical leaks. The umbilical 1 also carries lines to provide well maintenance, i.e. service/chemical/methanol feeds, and there is a risk that leaks to the seabed may occur in the jumpers feeding the trees from the UTA particularly when one supply line feeds a multiplicity of trees. The control center provides a platform for fitting isolation valves, which could be ganged with tree mounted valves to much reduced the risk of leaks and the consequential environmental damage.

9. Greater flexibility. If future, often unplanned, expansion of the field, or an upgrade of the control system is required it is comparatively simple to remove the control center and replace it with a new version.

10. Faster project execution. There is an increasing requirement from customers for suppliers to provide the trees and manifolds for a field with a quick turn-around, often only three months. As the controls are mounted at the single structure control center, with no controls mounted on the trees, there are fewer items to engineer and manufacture for the trees or manifold, thus enabling faster production turn around.

11. Improved availability. Since the jumpers from the UTA to the wells in the conventional system are effectively 'in parallel', a failure in one jumper can affect the functioning of all the SCM's on all of the trees in the field. The insertion of the control center with its SCM's, between the UTA and the wells substantially reduces the risk of such failures, since the number of susceptible jumpers is reduced to the single short jumper between the UTA and the control center. Furthermore, in the event of a failure at the UTA its recovery is much easier, as it no longer has a heavy distribution unit attached to it, but a single jumper connection instead.

The invention claimed is:

1. An apparatus for use in controlling and testing an underwater hydrocarbon production system, the apparatus comprising:

a plurality of well trees;

a manifold;

a unitary control center located subsea and spaced apart from the manifold and each of the plurality of trees, the unitary control center being in communication with the plurality of trees through a plurality of tree conduits extending therefrom; and a tree control module located at the unitary control center, the tree control module being in communication with the trees through the control center and the tree conduits so that the tree control module controls operations of the trees.

2. The apparatus according to claim 1, further comprising an umbilical termination assembly disposed at an end of an umbilical extending from the surface, the umbilical termination assembly connecting to the unitary control center for supplying control signals from a remote control location to the tree control module.

3. The apparatus according to claim 1, wherein the manifold is in communication with the trees.

4. The apparatus according to claim 2, further comprising a single communication line bundle extending from the umbilical termination assembly to the unitary control centre.

5. The apparatus according to claim 1, further comprising:

a manifold conduit extending from the unitary control centre to the manifold; and a manifold control module located at the unitary control centre, the manifold control module being in communication with the manifold through the unitary control centre and the manifold conduit so that the manifold control module controls operations of the manifold.

6. The apparatus according to claim 5, further comprising an umbilical termination assembly disposed at an end of an umbilical extending from the surface, the umbilical termination assembly connecting to the unitary control centre for supplying control signals from a remote control location to the tree control module and the manifold control module.

7. The apparatus according to claim 6, further comprising a single communication line bundle extending from the umbilical termination assembly to the unitary control centre.

8. An apparatus for use in controlling and testing an underwater hydrocarbon production system, the apparatus comprising:

a plurality of well trees;

a manifold;

a unitary control centre located subsea and spaced apart from the manifold and each of the plurality of trees, the unitary control centre being in communication with the plurality of trees through tree conduits extending therefrom, the unitary control centre being in communication with the manifold through a manifold conduit extending therefrom;

a tree control module located at the unitary control centre, the tree control module being in communication with the trees through the control centre and the tree conduits so that the tree control module controls operations of the trees; and a manifold control module located at the unitary control centre, the manifold control module being in communication with the manifold through the unitary control centre and the manifold conduit so that the manifold control module controls operations of the manifold.

9. The apparatus according to claim 8, further comprising an umbilical termination assembly disposed at an end of an umbilical extending from the surface, the umbilical termination assembly connecting to the unitary control centre for supplying control signals from a remote control location to the tree control module.

10. The apparatus according to claim 9, further comprising a single communication line bundle extending from the umbilical termination assembly to the unitary control centre.

11. The apparatus according to claim 8, wherein the manifold is in communication with the trees.

12. The apparatus according to claim 8, further comprising an umbilical termination assembly disposed at an end of an umbilical extending from the surface, the umbilical termination assembly connecting to the unitary control centre for supplying control signals from a remote control location to the tree control module and the manifold control module.

13. The apparatus according to claim 12, further comprising a single communication line bundle extending from the umbilical termination assembly to the unitary control centre.

14. An apparatus for use in controlling and testing an underwater hydrocarbon production system, the apparatus comprising:

a plurality of well trees;

a manifold;

a unitary control centre located subsea and spaced apart from the manifold and each of the plurality of trees, the unitary control centre being in communication with the plurality of trees through tree conduits extending therefrom, the unitary control centre being in communication with the manifold through a manifold conduit extending therefrom;

a tree control module located at the unitary control centre, the tree control module being in communication with the trees through the control centre and the tree conduits so that the tree control module controls operations of the trees;

a manifold control module located at the unitary control centre, the manifold control module being in communication with the manifold through the unitary control centre and the manifold conduit so that the manifold control module controls operations of the manifold; and an umbilical termination assembly disposed at an end of an umbilical extending from the surface, the umbilical termination assembly connecting to the unitary control centre for supplying control signals from a remote control location to the tree control module and the manifold control module.

15. The apparatus according to claim 14, further comprising a single communication line bundle extending from the umbilical termination assembly to the unitary control centre.

* * * * *